US006712119B2

(12) United States Patent
Yamamoto et al.

(10) Patent No.: US 6,712,119 B2
(45) Date of Patent: Mar. 30, 2004

(54) COLLECTED SAND PROCESSING METHOD

(75) Inventors: Shigeaki Yamamoto, Toyokawa (JP); Kuniyasu Mori, Toyokawa (JP); Ryoji Kanayama, Toyokawa (JP); Hisashi Harada, Toyokawa (JP); Hiroaki Tokita, Toyokawa (JP); Kazuo Sugimoto, Toyokawa (JP); Takehiko Matsumoto, Toyokawa (JP); Hiroyasu Makino, Toyokawa (JP); Yasunori Yoshida, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 0 days.

(21) Appl. No.: 10/220,340

(22) PCT Filed: Feb. 27, 2001

(86) PCT No.: PCT/JP01/01461

§ 371 (c)(1),
(2), (4) Date: Aug. 30, 2002

(87) PCT Pub. No.: WO01/64371

PCT Pub. Date: Sep. 7, 2001

(65) Prior Publication Data

US 2003/0037899 A1 Feb. 27, 2003

(30) Foreign Application Priority Data

| | | |
|---|---|---|
| Mar. 2, 2000 | (JP) | 2000-056869 |
| Mar. 10, 2000 | (JP) | 2000-065878 |
| Sep. 29, 2000 | (JP) | 2000-297736 |

(51) Int. Cl.[7] ..... B22C 9/02
(52) U.S. Cl. ..... 164/5; 164/349
(58) Field of Search ..... 164/5, 349

(56) References Cited

U.S. PATENT DOCUMENTS

| | | | | |
|---|---|---|---|---|
| 4,709,246 A | * | 11/1987 | Piatt et al. | 347/40 |
| 4,952,246 A | * | 8/1990 | Seeley | 134/3 |
| 5,992,499 A | * | 11/1999 | Tordoff et al. | 164/5 |
| 6,030,111 A | | 2/2000 | Tokuyoshi et al. | 366/2 |

* cited by examiner

*Primary Examiner*—M. Alexandra Elve
*Assistant Examiner*—Len Tran
(74) *Attorney, Agent, or Firm*—Finnegan, Henderson, Farabow, Garrett & Dunner LLP

(57) ABSTRACT

A method and apparatus are provided to process collected sand. This method and apparatus allow the moisture content to be adjusted and the addition of a binder to be facilitated to renew the collected sand as casting sand for future use. Also, defective castings are prevented when they are made by a main mold using the renewed casting sand. The sand-collecting means can be compact. The method is performed and the apparatus is operated by separating a main mold of green sand, after casting is conducted, into parts unaffected and affected by the molten metal heat, adjusting the moisture content of the part unaffected by molten metal heat for use as facing sand in the next main mold making, and adding a binder and adjusting the moisture content of the part affected by the molten metal heat for use as back sand in making the next main mold.

27 Claims, 4 Drawing Sheets

COLLECTED SAND PROCESSING METHOD

FIELD OF INVENTION

This invention relates to a method and apparatus for processing sand that is collected after a main mold made of green sand (or a main mold) is obtained after casting.

BACKGROUND OF INVENTION

Japanese Patent Laid-open Publication No. Hei. 10-249482 discloses a conventional method for processing collected salad wherein the main mold is separated into sand that has been exposed to a high temperature from molten metal and outer sand surrounding that sand, wherein the sands are collected, wherein water and a binder are added to the sand that has been exposed to a high temperature, and wherein then the sand is mixed with the outer sand, the mixture to be reused.

However, the conventional method for processing collected sand includes some disadvantages. For example, it is difficult to adjust the moisture content in the collected sand and to add a binder to it when it is reused as molding sand. Also, a defect can be caused in a mold when it is made by the main mold that is made by reusing the molding sand. Also, a large system is needed to separate affected and unaffected sand and to collect them through respective paths.

This invention has been conceived to overcome these disadvantages. The object of this invention is to provide a method and apparatus for processing collected sand. This method and apparatus allow the moisture content in collected sand to be easily adjusted and a binder to be easily added to the collected sand so as to renew it as molding sand. Also, no defect is caused in the mold even if it is made by the renewed molding sand, and the apparatus for collecting sand can be compact.

SUMMARY OF INVENTION

To achieve the objects stated above, a method is provided for processing sand that is collected, after casting, from a main mold of green sand. The method includes the steps for separating the main mold of green sand into a part that has been unaffected by the heat of molten metal and a part that has been affected by the heat of the molten metal, adjusting the moisture content in the part that has been unaffected by the heat of the molten metal to use that part as facing sand when a new main mold is made, and adding a binder to the part that has been affected by the heat of the molten metal and adjusting the moisture content in the part to use it as back sand when a new main mold is made.

Also, a method is provided for processing sand that is collected, after casting, from a main mold made of green sand. This method includes the steps of separating each main mold of green sand into a part that has been unaffected by the heat of the molten metal and a part that has been affected by the heat of the molten metal, separately collecting the part that has been unaffected by the heat of the molten metal and the part that has been affected by the heat of the molten metal adding a binder to the part that has been affected by the heat of the molten metal and adjusting the moisture content in that part, mixing at a predetermined ratio the part to which a binder is added and in which the moisture content is adjusted with the part that has been unaffected by the heat of the molten metal, and adjusting the moisture content in the mixed material to use it as molding sand.

Also, a method is provided for processing sand that is collected after casting from a main mold made of green sand. This method includes the steps of separating each main mold of green sand into a part that has been unaffected by the heat of molten metal and a part that has been affected by the heat of the molten metal, separately collecting the part that has been unaffected by heat of molten metal and the part that has been affected by the heat of the molten metal mixing at a predetermined ratio the two kinds of the collected sand, adding a binder to the mixed sand, and adjusting the moisture content in the mixed sand to use it as molding sand.

Also, a method is provided for processing green sand for a main mold that is obtained by separating and collecting a main mold of green sand after casting. This method includes the steps of separating each main mold of green sand into a part that has been unaffected by the heat of molten metal and a part that has been affected by the heat of the molten metal, separately storing in respective storing means the part that has been unaffected by the heat of molten metal and the part that has been affected by the heat of the molten metal, processing and collecting the sand that has been separated and stored in the respective storing means by transferring the sand through the same path at different times, and collecting them in respective storing means, mixing at a predetermined ratio the two kinds of collected sand, and adjusting the moisture content in the mixed sand to use it as molding sand.

This processing method includes the step for collecting the parts by transferring the parts through the same path at different times. Thus, this method allows the moisture content in the parts to be easily adjusted and allows the binder to easily be added to the parts. Also, no defect is caused in molds even if they are made by the renewed molding sand. A large system is unneeded.

Also, an apparatus is provided for processing sand that is separated and collected from a main mold made of green sand after casting. This apparatus comprises means for separating each main mold made of green sand into a part that has been unaffected by the heat of molten metal and a part that has been affected by the heat of the molten metal and storing the parts, and means for separately collecting the part that has been unaffected by the heat of molten metal and the part that has been affected by the heat of the molten metal, which parts are then separated and stored. This apparatus also comprises means for separately storing the part that has been unaffected by the heat of the molten metal and the part that has been affected by that heat, which parts are separately collected, clay- and moisture-content-adjusting means for adding a binder to the part that has been affected by the heat and adjusting the moisture content in the part, blending means for blending the part that has been unaffected by the heat of the molten metal and the part that has been affected by that heat at a predetermined ratio, and mixing means for adjusting the moisture content in the parts and mixing the parts.

This apparatus does not need a plurality of collecting means. Thus, this apparatus can be compact. Also, this apparatus allows the moisture content in the parts to be easily adjusted and allows the binder to be easily added to the parts. Also, no defect is caused in molds even if they are made by the renewed molding sand. A large system is unneeded.

DETAILED EXPLANATION OF PREFERRED EMBODIMENT

The step of this invention for separating the main mold after casting into a part that has been affected by the heat of molten metal and a part that has been unaffected by that heat can be achieved by making the pressure negative in an airtight member.

That is, just after casting the main mold is put in an airtight member and then the pressure in the airtight member is made negative. This results in the boiling point of all the moisture in the main mold that contains the moisture in a water-condensed layer being lowered, so that the part that has been unaffected by the heat of the molten metal is broken and separated from the other part.

The words "just after casting" denote the time when the molten metal in the main mold is hardened and a mold is defined.

If each main mold of green sand is separated into a part that has been unaffected by the heat of molten metal and a part that has been affected by that heat, the parts can be prevented from being mixed. Also, adding too much of an additive agent is prevented, so that controlling the moisture content can be relatively easy. If the main molds are individually separated, then even if defective molds are made, the conditions for the mold types, the molten metal, etc., can be easily defined, so that this problem can be easily overcome.

Figure 1:
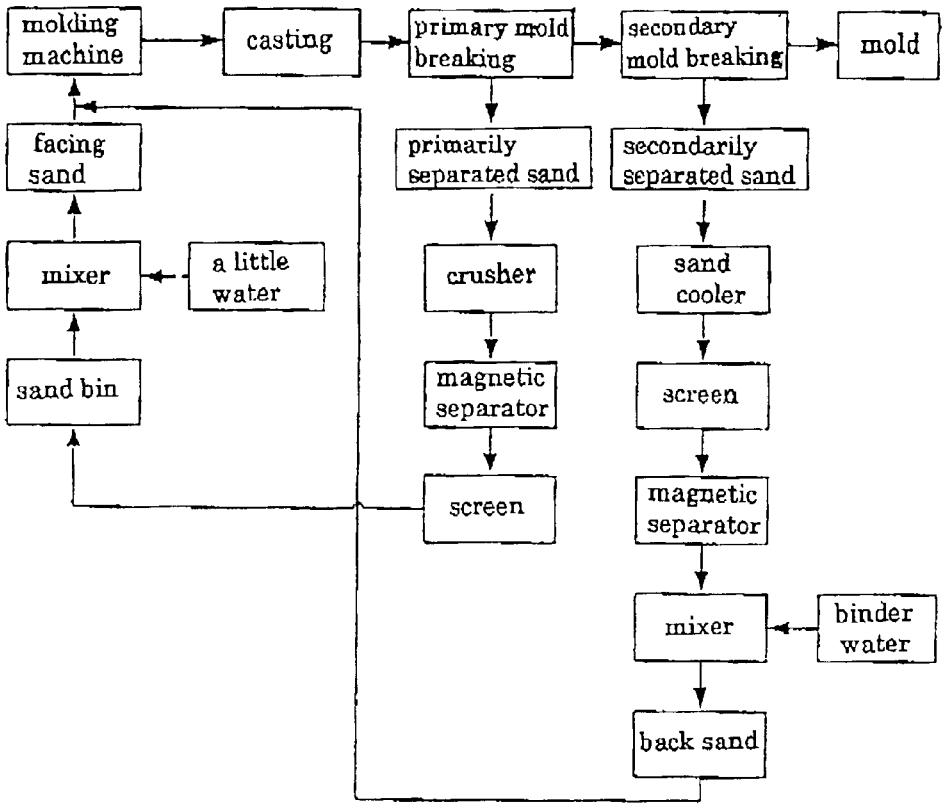
FIG. 1 is a flowchart describing a first embodiment of this invention.

Based on FIG. 1 a first embodiment of this invention is now discussed. As in FIG. 1, molten metal is cast in a main mold that is molded by a molding machine. Then, after casting the main mold is put in an airtight member. The mold material in the main mold has, at an outer part, a layer (or a condensed-water layer) in which much water is collected which layer is heated by the heat of the mold material to a high temperature. If the pressure in the airtight member is rapidly decreased to be negative, the boiling point of the water in the main mold that contains the water in the condensed-water layer is lowered, and thus the water is boiled. As a result, the part that has been unaffected by the heat of the molten metal is broken.

Thus, the main mold is separated into the part that has been unaffected by the heat of the molten metal and the part that has been affected by that heat (or a primary mold breaking), The part that has been unaffected by the heat of the molten metal is collected as collected sand (or primarily separated sand), and then is crushed by a crushing machine into particles. Then metal pieces are removed from the particles by a magnetic separator. The particles are sifted by a screen to select particles having predetermined sizes. The collected and sifted sand is temporarily held by a sand bin. Then, the sand is taken out from the sand bin. Then the moisture in the sand is adjusted by a mixer. The mixed sand is used as facing sand to mold the main mold.

The part that has been affected by the heat of the molten metal is separated from the molding material (or a secondary mold breaking) by a blast-processing operation, etc., because this part is attached to the molding material. That separated part, which has been affected by the heat of the molten metal (or secondarily separated sand), is cooled, and then sifted by a screen to take out particles having predetermined sizes. Any metal pieces are removed by the magnetic separator from the collected and sifted sand. The sand is mixed with a binder and water by adding them to the sand bit by bit. The mixed collected sand is used as back sand when the main mold is molded.

The first embodiment is a method for processing sand that is collected from a main mold of green sand after casting. By this method the main mold is separated, after casting, into a part that has been affected by the heat of the molten metal and a part that has been unaffected by that heat. The moisture content contained in the part that has been unaffected is adjusted. That part is used as facing sand for a following molding operation using the main mold. A binder is added to the part that has been affected by the heat of the molten metal. The moisture content in this part is adjusted. This part is used as back sand for the following molding operation of the main mold. Thus, many practical effects are produced by this embodiment. That is, this embodiment allows the adjustment of the moisture content and the addition of the binder to be easily made. No defect is made in molds even if they are made from the main molds that are made of the renewed molding sand.

Figure 2:
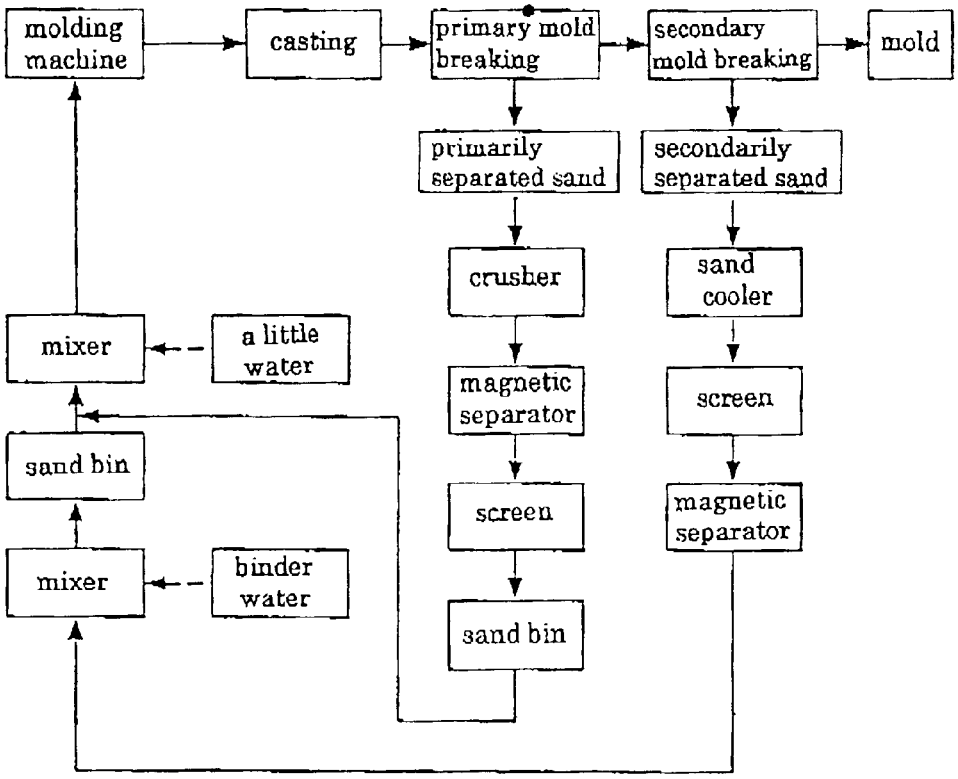
FIG. 2 is a flowchart describing a second embodiment of this invention.
Figure 3:
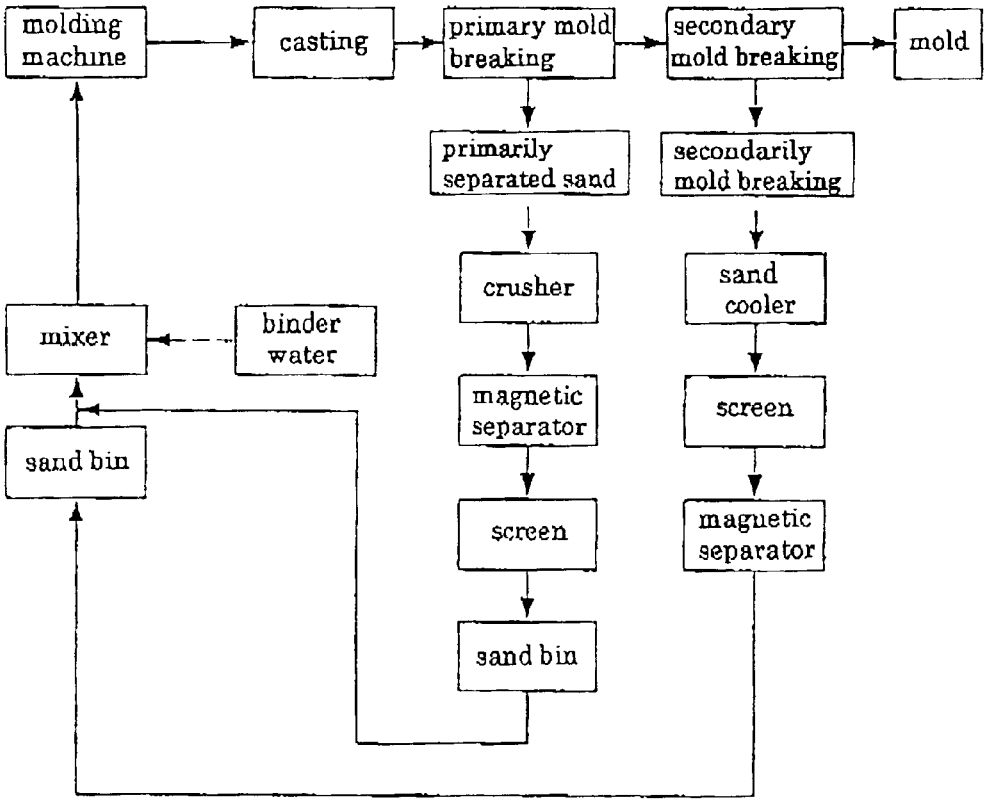
FIG. 3 is a flowchart describing a third embodiment of this invention.

Based on FIGS. 2 and 3, second and third embodiments of this invention are now discussed. As in FIG. 2, in the second embodiment, casting is conducted by using a main mold that is molded by a molding machine. Then, the main mold is put, after casting, in an airtight member. The mold material in the main mold has, at an outer part, a layer (or a condensed-water layer) in which much water is collected, which layer is heated by the heat of the mold material to a high temperature. If the pressure in the airtight member is rapidly decreased, the boiling point of the water in the main mold that contains the water in the condensed-water layer is lowered and thus the water is boiled. As a result, the part that has been affected by the heat of the molten metal is broken.

Thus, the main mold is separated into the part that has been unaffected by the heat of the molten metal and the part that has been affected by that heat (or a primary mold breaking). The part of each main mold that has been unaffected by the heat of the molten metal is broken and separated, and then is collected as collected sand (or primarily separated sand). Then the collected sand is crushed by a crushing machine into particles. Then, any metal pieces are removed from the particles by a magnetic separator. The particles are sided by a screen to take out particles having predetermined sizes. The collected and sifted sand is temporarily held in a sand bin.

The part that has been affected by the heat of the molten metal is separated from the molding material (or a secondary mold breaking) by a blast processing operation, etc., because this part is attached to the molding material. That separated part, which has been affected by the heat of the molten metal (or secondarily separated sand), is cooled by a sand cooler to a predetermined temperature, and then sifted by a screen to take out particles having predetermined sizes. Any metal pieces are removed by the magnetic separator from the collected and sifted sand. The sand is mixed with a binder and water by adding them to the sand bit by bit. The mixed and collected sand is temporarily stored in the sand bin.

Then, the two kinds of collected sand that are separately stored in two sand bins are taken out from the sand bins at each preset quantity and are put into the mixer. The collected sand is then mixed by the mixer with water added little-by-little, and is used as molding sand.

This embodiment is a method for processing sand that is collected from a main mold made of green sand after casting. By this method each main mold is separated, after casting, into a part that has been affected by the heat of the molten metal and a part that has been unaffected by that heat.

The part that has been affected by the heat of the molten metal and the part that has been unaffected by that heat are collected separately. A binder is added to the part that has been affected by the heat of the molten metal. The moisture content in this part is adjusted. This part is mixed with the part that has been unaffected by the heat at a predetermined ratio. Finally, the water content contained in the mixed sand is adjusted. The sand is used as molding sand. Thus, many practical effects can be produced by this invention. That is, this embodiment allows the adjustment of the moisture content and the addition of the binder to be easily made. No defect is made in molds even if they are made from the main molds that are made of the renewed molding sand.

FIG. 3 shows a third embodiment of this invention. As in FIG. 3, in this embodiment, casting is conducted using a main mold that is molded by a molding machine. Then, the main mold is put, after casting, in an airtight member. The mold material in the main mold has, at an outer part, a layer (or a condensed-water layer) in which much water is collected, which layer is heated by the heat of the mold material to a high temperature. If the pressure in the airtight member is rapidly decreased, the boiling point of the water in the main mold that contains the water in the condensed-water layer is lowered and thus the water is boiled. As a result the part that has been unaffected by the heat of the molten metal is broken.

Thus, the main mold is separated into the part that has been unaffected by the heat of the molten metal and the part that has been affected by that heat (or a primary mold breaking). The part of each main mold that has been unaffected by the heat of the molten metal is broken and separated, and then is collected as collected sand (or primarily separated sand) Then, the collected sand is crushed by a crushing machine into particles. Then, any metal pieces are removed from the particles by a magnetic separator. The particles are sifted by a screen to take out particles having predetermined sizes. The collected and sifted sand is temporarily held by a sand bin.

The part that has been affected by the heat of the molten metal is separated from the molding material (or a secondary mold breaking) by a blast processing operation, etc., because this part is attached to the molding material. That separated part, which has been affected by the heat of the molten metal (or secondarily separated sand), is cooled by a sand cooler to a predetermined temperature, and then sifted by a screen to take out particles having predetermined sizes. Metal pieces are removed by a magnetic separator from the collected and sifted sand. The sand is temporarily stored in the sand bin.

Then, the two kinds of the collected sand that are separately stored in two sand bias are taken out from the sand bins at each preset quantity and are put into the mixer. The collected sand is then mixed by the mixer with a binder and water added little-by-little, and is used as molding sand.

The third embodiment is a method for processing sand that is collected from a main mold made of green sand after casting. By this method each main mold is separated, after casting, into a part that has been affected by the heat of the molten metal and a part that has been unaffected by that heat. The part that has been affected by the heat of the molten metal and the part that has been unaffected by that heat are collected separately. The two kinds of collected sand are mixed at a predetermined ratio. Then, a binder is added to the mixed sand. Also, the moisture content in the mixed sand is adjusted. It is used as molding sand. Thus, many practical effects are produced by this invention. That is, this embodiment allows the easy adjustment of the moisture content and the addition of a binder. No defect is made in molds even if they are made of the main molds that are made of the renewed molding sand.

Figure 4:
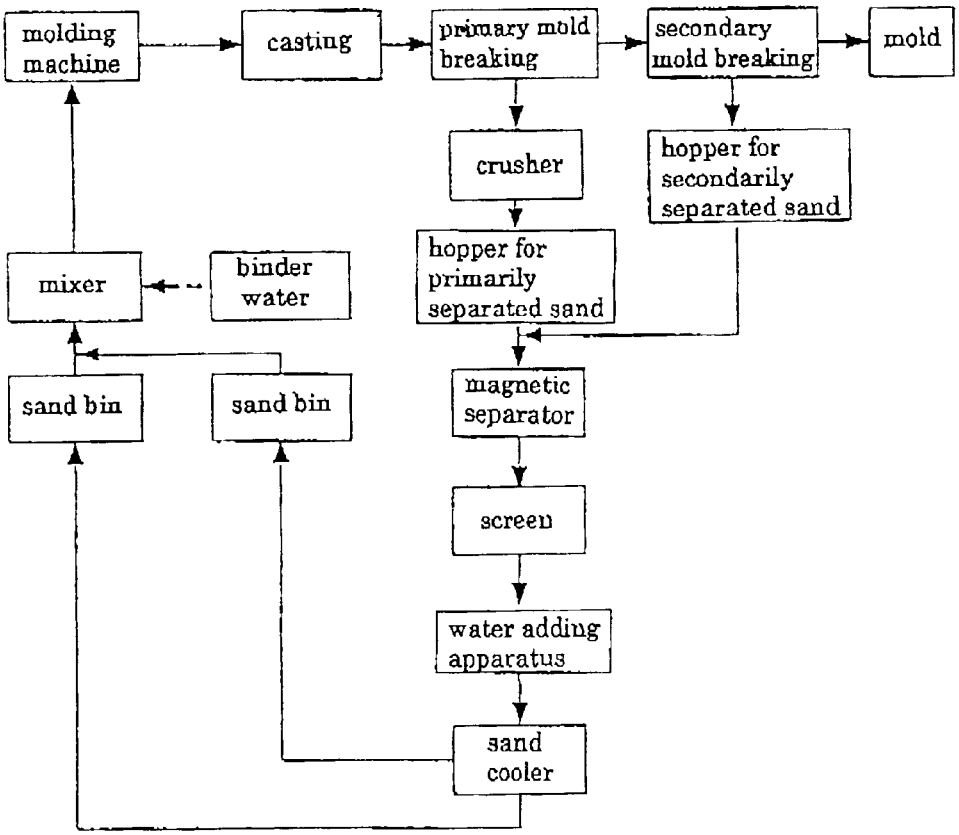
FIG. 4 is a flowchart describing a fourth embodiment of this invention.

Based on FIG. 4 a fourth embodiment of this invention is now discussed. This embodiment relates to an apparatus for processing green sand for a main mold that is obtained by separating the main mold made of green sand after casting, and by collecting them. As in FIG. 4, the apparatus has a separating and storing means. It comprises a separating means for separating each main mold made of green sand into a part that has been unaffected by the heat of the molten metal and a part that has been affected by that heat (or means performing primary and secondary breakings), and a storing means for storing the separated parts (or a primary separating hopper and a secondary separating hopper).

Downstream of the separating and storing means a collecting means is located. It includes a magnetic separator, a screen, a water-adding apparatus, a sand cooler, and means for connecting them. The collecting means separately collects the part that has been unaffected by the heat of the molten metal and the part that has been affected by that heat, which parts have been previously separated and collected.

Downstream of the collecting means two storing means (or two sand bins) are located for collected sand, to separately collect the part that has been unaffected by the heat of the molten metal and the part that has been affected by that heat, which parts are separated and collected.

Downstream of the storing means is located a clay- and moisture-content-adjusting means to add a binder to the sand and to adjust the moisture content in the sand.

Downstream of the clay- and moisture-content-adjusting means is located a blending means for blending the collected sand that is adjusted by the clay- and moisture-content-adjusting means and the collected sand that has been unaffected at a predetermined ratio, and a miring means for mixing them after the moisture is adjusted in them.

Now the operation of the fourth embodiment of this invention is discussed. As in FIG. 4, by the method for processing the green sand for a main mold, casting is conducted using the main mold that is molded by a molding machine. Then, the main mold is put, after casting, in an airtight member. The mold material in the main mold has, at an outer part, a layer (or a condensed-water layer) in which much water is collected, which layer is heated by the heat of the mold material to a high temperature. If the pressure in the airtight member is rapidly decreased, the boiling point of the water in the main mold that contains the water in the condensed-water layer is lowered, and thus the water is boiled. As a result, the part that has been unaffected by the heat of the molten metal is broken.

Thus, the main mold is separated into the part that has been unaffected by the heat of the molten metal and the part that has been affected by that heat (or a primary mold breaking). The part of each main mold that has been unaffected by the heat of the molten metal is broken and separated, and then is collected as collected sand. Then the collected sand is crushed by a crushing machine into particles. Then, the particles are temporarily stored in a primary hopper for separated sand.

The part that has been affected by the heat of the molten metal is separated from the molding material (or a secondary mold breaking) by a blast-processing operation, etc, because this part is attached to the molding material. That separated part, which has been affected by the heat of the molten metal, is temporarily stored in a secondary hopper for separated sand (or storing means) differing from the primary hopper.

Then, any metal pieces are removed from the primarily separated sand by a magnetic separator. The primarily separated sand is sited by a screen to take out particles having predetermined sizes. When there is insufficient water in the sand, a moisture-content-adding apparatus adds water to the sand. Then, the sand is cooled by the sand cooler to a preset temperature and temporarily stored in a sand bin (or storing means for collected sand).

When a set time has passed after the primarily separated sand has been collected, a secondarily separated sand is transferred through the same path to remove metal pieces from the sand and to be sifted to take out particles having predetermined sizes. When the sand has insufficient water, more water is added. Then, the secondarily separated sand is cooled by the sand cooler to a preset temperature and temporarily stored in another sand bin (or storing means).

The primary and secondary sands are processed at different tines through the same path. The processing operations for them differ. For example, water is added depending on the temperatures and the water content in the collected sand. Also, the conditions of the magnetic separator and the screen may be changed. Thus, the sand may be adjusted before it is transferred to the storing means for the collected sand, so that subsequent processing operations can be simplified.

The two kinds of collected sand that are separately stored in two sand bins are taken out at each predetermined quantity from the sand bins, and put into the mixer. Then, the sand is mixed with water and a binder by adding them little-by-little. The sand is used as molding sand. The binder and water may be preliminarily added to the sand before the sand is taken out of the sand bins and put in the mixer.

In the fourth embodiment, after the primarily separated sand is collected, the secondarily separated sand is collected. However, the order may be changed. In that case a timer or a level switch is used to change the order. The two storing means for separated sand may be built as one unit if it can separately store the primarily separated sand and the secondarily separated sand.

As discussed above, the method for the fourth embodiment is a method for processing green sand for a main mold that is separated and collected after casting is conducted from a main mold of green sand. By this method each main mold is separated, after casting, into a part that has been unaffected by the heat of the molten metal and a part that has been affected by that heat. The part that has been unaffected by the heat of the molten metal and the part that has been affected by that heat are collected separately in respective storing means for storing the separated sand. The parts of the sand that are stored in the storing means are transferred through the same path at different times. Then, the two kinds of collected sand are mixed at a predetermined ratio, and their moisture content is adjusted. The sand is used as molding sand. Thus, this embodiment allows the adjustment of the moisture content and the addition of the binder to be easily made. No defect is made in molds even if they are made of the main molds that are made of the renewed molding sand. A large system is not needed.

Also, the apparatus for the fourth embodiment is an apparatus for processing green sand for a main mold that is separated and collected from a main mold of green sand after casting. This apparatus includes a separating and storing means to separate each main mold, after casting is conducted, into a part that has been unaffected by the heat of the molten metal and a part that has been affected by that heat and to store them, a means for separately collecting the part that has been unaffected by the heat of the molten metal and the part that has been affected by that heat, and a means for separately storing the part that has been unaffected by the heat of the molten metal and the part that has been affected by that heat which parts are separately collected. The apparatus also includes a clay and moisture-content-adjusting means for adding a binder to the part that has been affected by the heat and adjusting the moisture content in that part, a blending means for blending the part that has been unaffected by the heat of the molten metal and the part that has been affected by that heat at a predetermined ratio, and a mixing means for adjusting their moisture content and for mixing the parts. Thus, this embodiment allows the easy adjustment of the moisture content and the addition of the binder, so as to use the sand as molding sand. No defect is made in molds even if they are made of the main molds that are made of the renewed molding sand. A large system is not needed.

What is claimed is:

1. A method for processing collected sand that is collected from a main mold of green sand after casting is conducted, including the steps of separating the main mold of green sand into a part that has been unaffected by heat of molten metal and a part that has been affected by the heat of the molten metal, adjusting the moisture content in the part that has been unaffected by the heat of the molten metal to use the part as facing sand when a new main mold is made, and adding a binder to the part that has been affected by the heat of the molten metal and adjusting the moisture content in the part to use the part as back sand when a new main mold is made.

2. The method of claim 1 wherein the step for separating the main mold of green sand, after casting is conducted, into a part that has been unaffected by heat of molten metal and a part that has been affected by the heat of the molten metal is achieved by making the pressure negative in an airtight member in which the green sand mold is put just after casting.

3. A method for processing collected sand that is inflected from a main mold of green saint after casting is conducted, including the steps of separating each main mold of green sand into a part that has been unaffected by heat of molten metal and a part that has been affected by the heat of the molten metal, separately collecting the part that has been unaffected by heat of molten metal and the part that has been affected by the heat of the molten metal, adding a binder to the part that has been affected by the beat of the molten metal and adjusting the moisture content in the part, mixing at a predetermined ratio the part to which a binder is added and in which the moisture content is adjusted with the part that has been unaffected by the heat of the molten metal, and adjusting the moisture content in the mixed material to use it as molding sand, wherein the step for separating the main mold of green sand into a part that has been unaffected by heat of molten metal and a part that has been affected by the heat of the molten metal is achieved by making the pressure negative in an airtight member in which the green sand mold is put just after casting.

4. A method for processing collected sand that is collected from a main mold of green sand after casting is conducted, including the steps of separating each main mold of green sand into a part that has been unaffected by heat of molten metal and a part that has been affected by the heat of the molten metal, separately collecting the part that has been unaffected by heat of molten metal and the part that has been affected by the heat of the molten metal, mixing at a predetermined ratio the two kinds of collected sand, and adding a binder to the mixed sand and adjusting the moisture content in the mixed sand to use it as molding sand.

5. The method of claim 4 wherein the step for separating the main mold made of green sand into a part that has been unaffected by heat of molten metal and a part that has been affected by the heat of the molten metal is achieved by making the pressure negative in an airtight member in which the green sand mold is put just after casting.

6. A method for processing green sand for a main mold that is obtained by separating and collecting a main mold of green sand after casting is conducted, including the steps of separating each main mold of green sand into a part that has been unaffected by heat of molten metal and a part that has been affected by the heat of the molten metal, separately staring in respective storing means the part that has been unaffected by heat of molten metal and the part that has been affected by the heat of the molten metal, processing and collecting the send that is separated and stored in the respective storing means by transferring the sands through the same path at different times, and collecting them in respective storing means, mixing at a predetermined ratio the two kinds of collected sand, and adjusting the moisture content in the mixed sand to use it as molding sand.

7. The method of claim 6 wherein during the transfer through the same path, the step for processing and collecting the sand that has been affected by the heat of the molten metal differs from that for the sand that has been unaffected by to heat of the molten metal.

8. The method of claim 7 wherein the step for processing and collecting the sand by transferring the sands through the same path includes the step for adding moisture to the sand according to the temperature of the collected sand and the moisture content.

9. The method of claim 6 wherein after the step is performed for adding the hinder to the sand that has been affected by the heat of the molten metal and for adjusting the moisture content in the sand, the sand that has been unaffected by the heat and that is stored is mixed with that sand at a predetermined ratio.

10. The method of claim 7 wherein after the step is performed for adding the binder to the sand that has been affected by the heat of the molten metal and for adjusting the moisture content in the sand, the sand that has been unaffected by the heat and that is stored is mixed with that sand at a predetermined ratio.

11. The method of claim 8 wherein after the step is performed for adding the binder to the sand that has been affected by the heat of the molten metal and for adjusting the moisture content in the sand, the sand that has been unaffected by the heat and that is stored is mixed with that sand at a predetermined ratio.

12. The method of claim 9 wherein after the step is performed for separately collecting in the storing means the part that has been unaffected by heat of molten metal and the part that has been affected by the heat of the molten metal, the two kinds of collected sand are mixed at a predetermined ratio, and then the binder is added to the mixed sand.

13. The method of claim 10 wherein, after the step is performed for separately collecting in the storing means the part that has been unaffected by heat of molten metal and the part that has been affected by the heat of the molten metal, the two kinds of collected sand are inked at a predetermined ratio, and then the binder is added to the mixed sand.

14. The method of claim 11 wherein, after the step is performed for separately collecting in the storing means the part that has been unaffected by heat of molten metal and the part that has been affected by the heat of the molten metal, the two kinds of collected sand are mixed at a predetermined ratio, and then the binder is added to the mixed sand.

15. The method of claim 12 wherein the step for separating the main mold of green sand, after casting is conducted, into a part that has been unaffected by heat of molten metal and a part that has been affected by the heat of the molten metal is achieved by making the pressure negative in an airtight member in which the green sand mold is put just after casting.

16. The method of claim 13 wherein the step for separating the main mold of green sand, after casting is conducted, into a part that has been unaffected by heat of molten metal and a part that has been affected by the heat of the molten metal is achieved by making the pressure negative in an airtight member in which the green sand mold is put just after casting.

17. The method of claim 14 wherein the step for separating the main mold of green sand, after casting is conducted, into a part that has been unaffected by beat of molten metal and a part that has been affected by the beat of the molten metal is achieved by making the pressure negative in an airtight member in which the green sand mold is put just after casting.

18. The method of claim 6 wherein, after the step is performed for separately collecting in the storing means the part that has been unaffected by heat of molten metal and the part that has been affected by the heat of the molten metal the two kinds of collected sand are mixed at a predetermined ratio, and then the binder is added to the mixed sand.

19. The method of claim 7 wherein, after the step is performed for separately collecting in the storing means the part that has been unaffected by heat of molten metal and the part that has been affected by the heat of the molten metal, the two kinds of collected sand are mixed at a predetermined ratio, and then the binder is added to the mixed sand.

20. The method of claim 8 wherein, after the step is performed for separately collecting in the storing means the part that has been unaffected by heat of molten metal and the part that has been affected by the heat of the molten metal, the two kinds of collected sand are mixed at a predetermined ratio, and then the binder is added to the mixed sand.

21. The method of claim 18 wherein the step for separating the main mold of green sand, after casting is conducted, into a part that has been unaffected by heat of molten metal and a part that has been affected by the heat of the molten metal is achieved by making the pressure negative in an airtight member in which the green sand mold is put just after casting.

22. The method of claim 19 wherein the step for separating the main, mold of green sand, after casting is conducted, into a part that has been unaffected by heat of molten metal and a part that has been affected by the heat of the molten metal is achieved by making the pressure negative in an airtight member in which the green sand mold is put just after casting.

23. The method of claim 20 wherein the step for separating the main mold of green sand, after casting is conducted, into a part that has been unaffected by heat of molten metal and a part that has been affected by the heat of the molten metal is achieved by making the pressure negative in an airtight member in which the green sand mold is put just after casting.

24. The method of claim 6 wherein the step for separating the main mold of green sand, after casting is conducted, into a part that has been unaffected by heat of molten metal and a part that has been affected by the heat of the molten metal is achieved by making the pressure negative in an airtight member in which the green sand mold is put just after casting.

25. The method of claim 7 wherein the step for separating the main mold of green sand, after casting is conducted, into a part that has been unaffected by heat of molten metal and a part that has been affected by the heat of the molten metal is achieved by making the pressure negative in an airtight member in which the green sand mold is put just after casting.

26. The method of claim 8 wherein the step for separating the main mold of green sand, after casting is conducted, into a part that has been unaffected by heat of molten metal and a part that has been affected by the heat of the molten metal is achieved by making the pressure negative in an airtight member in which the green sand mold is put just after casting.

27. An apparatus for processing collected sand that is separated and collected from a main mold of green sand after casting comprising means for separating each main mold of green sand into a part that has been unaffected by heat of molten metal and a part that has been affected by the heat of the molten metal and storing the parts, means for separately collecting the part that has been unaffected by heat of molten metal and the part that has been affected by the heat of the molten metal, which parts are separated and stored, means for separately storing the part that has been unaffected by the heat of the molten metal and the part that has been affected by that heat, which parts are separately collected, clay- and moisture-content-adjusting means for adding a binder to the part that has been affected by the heat and adjusting the moisture content in the part, blending means for blending the part that has been unaffected by the heat of the molten metal and the part that has been affected by that heat at a predetermined ratio, and mixing means for adjusting the moisture content in the parts and mixing the parts.

* * * * *

UNITED STATES PATENT AND TRADEMARK OFFICE

CERTIFICATE OF CORRECTION

PATENT NO. : 6,712,119 B2
DATED : March 30, 2004
INVENTOR(S) : Shigeaki Yamamoto et al.

It is certified that error appears in the above-identified patent and that said Letters Patent is hereby corrected as shown below:

Column 8,
Line 38, “inflected” should read -- collected --.
Line 39, “saint” should read -- sand --.
Line 48, “beat” should read -- heat --.

Column 9,
Line 22, “staring” should read -- storing --.
Line 26, “send” should read -- sand --.
Line 45, “hinder” should read -- binder --.

Column 10,
Line 5, “inked” should read -- mixed --.
Line 29, “by beat” should read -- by heat --.
Line 30, “the beat” should read -- the heat --.
Line 37, after “the molten metal” insert a comma.
Line 60, “main, mold” should read -- main mold --.

Column 12,
Line 7, “metal and” should read -- metal, and --.

Signed and Sealed this

Sixteenth Day of November, 2004

JON W. DUDAS
*Director of the United States Patent and Trademark Office*